US011826610B2

(12) United States Patent
Griffin

(10) Patent No.: US 11,826,610 B2
(45) Date of Patent: Nov. 28, 2023

(54) LEG EXERCISE ASSEMBLY

(71) Applicant: Gail Griffin, Culver, IN (US)

(72) Inventor: Gail Griffin, Culver, IN (US)

( * ) Notice: Subject to any disclaimer, the term of this patent is extended or adjusted under 35 U.S.C. 154(b) by 119 days.

(21) Appl. No.: 17/464,381

(22) Filed: Sep. 1, 2021

(65) Prior Publication Data

US 2023/0061525 A1 Mar. 2, 2023

(51) Int. Cl.
*A63B 22/20* (2006.01)

(52) U.S. Cl.
CPC ..... *A63B 22/203* (2013.01); *A63B 2220/62* (2013.01); *A63B 2230/75* (2013.01)

(58) Field of Classification Search
CPC ..... A63B 22/20; A63B 22/201; A63B 22/203; A63B 22/205; A63B 22/208; A63B 2230/75
See application file for complete search history.

(56) References Cited

U.S. PATENT DOCUMENTS 4,653,749 A * 3/1987 Rorabaugh ..... A63B 69/182 482/114
4,979,731 A * 12/1990 Hermelin ..... A63B 22/001 482/70
5,192,257 A * 3/1993 Panasewicz ..... A63B 69/0057 482/134
5,267,923 A 12/1993 Piaget
5,279,531 A * 1/1994 Jen-Huey ..... A63B 21/154 482/54
5,492,515 A * 2/1996 Charnitski ..... A63B 22/205 482/37
5,833,584 A * 11/1998 Piaget ..... A63B 22/203 482/70
5,984,841 A 11/1999 John
6,024,680 A * 2/2000 Thompson, II ..... A63B 22/203 482/79
6,217,488 B1 4/2001 Bernardson
D481,085 S 10/2003 Ben-Moshe
6,709,368 B1 3/2004 Chue
D514,175 S 1/2006 Sugiyama
8,550,963 B1 10/2013 Bradford
9,186,551 B1 * 11/2015 Smith ..... A63B 22/203
9,283,428 B1 * 3/2016 Esrick ..... A63B 21/012
11,191,692 B2 * 12/2021 Aspinal ..... A61H 1/0259
2009/0176630 A1 * 7/2009 Larson ..... A63B 69/0057 482/68

(Continued)

*Primary Examiner* — Loan B Jimenez
*Assistant Examiner* — Zachary T Moore
(74) *Attorney, Agent, or Firm* — Warnot

(57) ABSTRACT

A leg exercise assembly includes a housing that is positionable near a user's feet. A pair of foot pads is each disposed on the housing for having a respective one of the user's feet positioned upon the foot pads. A pair of roller units is each rollably integrated into the housing and each of the foot pads is coupled to a respective one of the pair of roller units for sliding the foot pads back and forth on the housing. A resistance unit is movably integrated into the housing for either increasing or decreasing the force required to move the footpads to accommodate the physical strength of the user. A calorie counter is integrated into the housing and the calorie counter counts each time the pair of roller units is moved back and forth to calculate the calories being burnt by the user.

3 Claims, 6 Drawing Sheets

(56) References Cited

U.S. PATENT DOCUMENTS

| | | | | |
|---|---|---|---|---|
| 2013/0237393 | A1* | 9/2013 | Kerdjoudj | A63B 21/4033 482/122 |
| 2020/0061410 | A1* | 2/2020 | Hildebrandt | A63B 22/203 |
| 2020/0121969 | A1* | 4/2020 | Spelman | A63B 69/0057 |

* cited by examiner

LEG EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise device and more particularly pertains to a new exercise device for exercising a user's legs while the user is seated. The device includes a pair of foot pads that are slidably coupled to a housing such that the user can place their feet on the foot pads and slide their feet back and forth while the user is seated. The device includes a resistance unit for adjusting resistance of the foot pads and a calorie counter for counting calories burned.

(2) Description of Related Art Including Information Disclosed Under 37 CFR 1.97 and 1.98

The prior art relates to exercise devices including a variety of leg exercise machines that include a pair of foot pedals that are hingedly disposed on a housing to facilitate a user to exercise their legs when the user is seated. In no instance does the prior art disclose a foot exercise machine that includes foot pads which slide laterally on a housing.

BRIEF SUMMARY OF THE INVENTION

An embodiment of the disclosure meets the needs presented above by generally comprising a housing that is positionable near a user's feet. A pair of foot pads is each disposed on the housing for having a respective one of the user's feet positioned upon the foot pads. A pair of roller units is each rollably integrated into the housing and each of the foot pads is coupled to a respective one of the pair of roller units for sliding the foot pads back and forth on the housing. A resistance unit is movably integrated into the housing for either increasing or decreasing the force required to move the footpads to accommodate the physical strength of the user. A calorie counter is integrated into the housing and the calorie counter counts each time the pair of roller units is moved back and forth to calculate the calories being burnt by the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
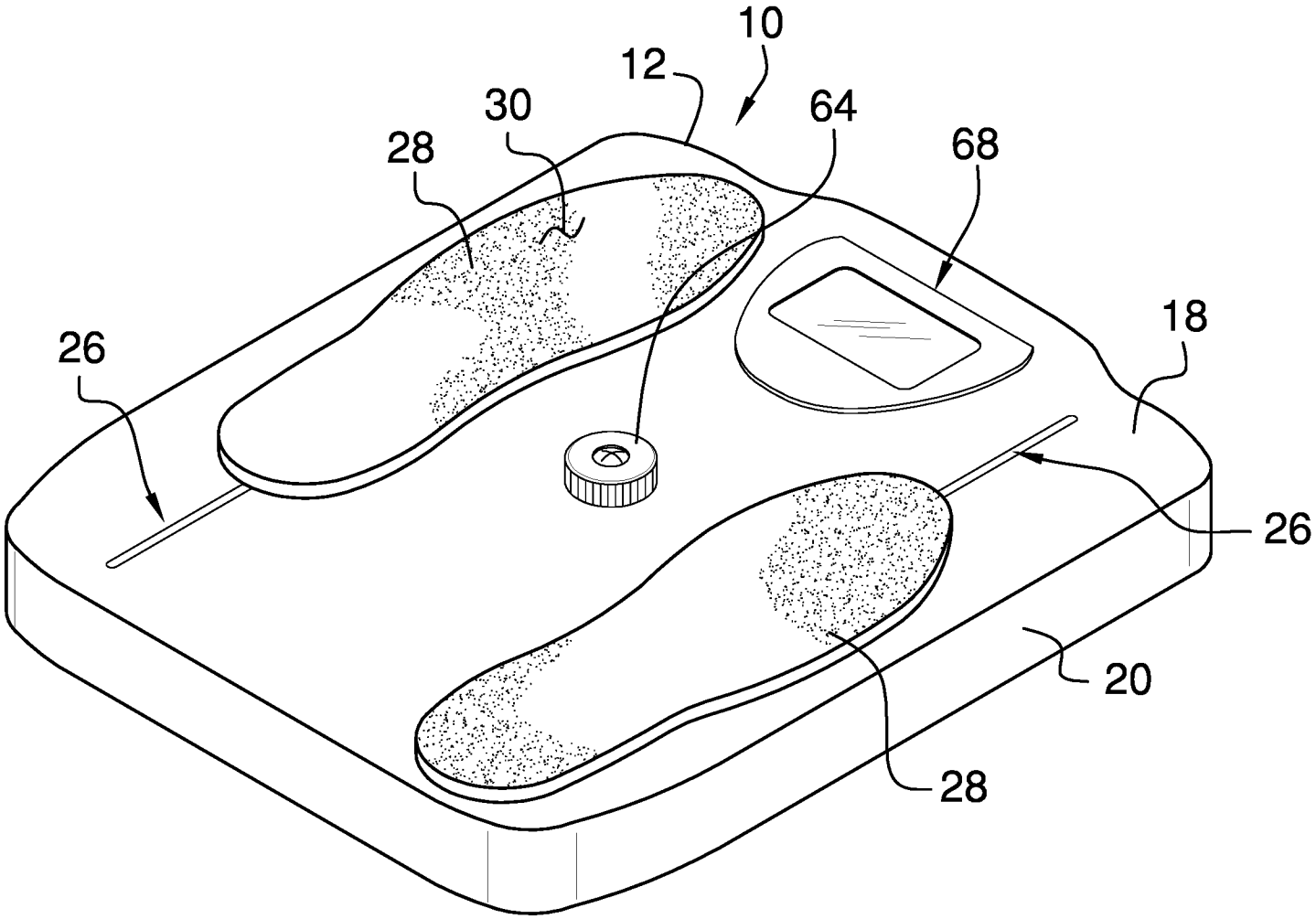
FIG. 1 is a top perspective view of a leg exercise assembly according to an embodiment of the disclosure.
Figure 2:
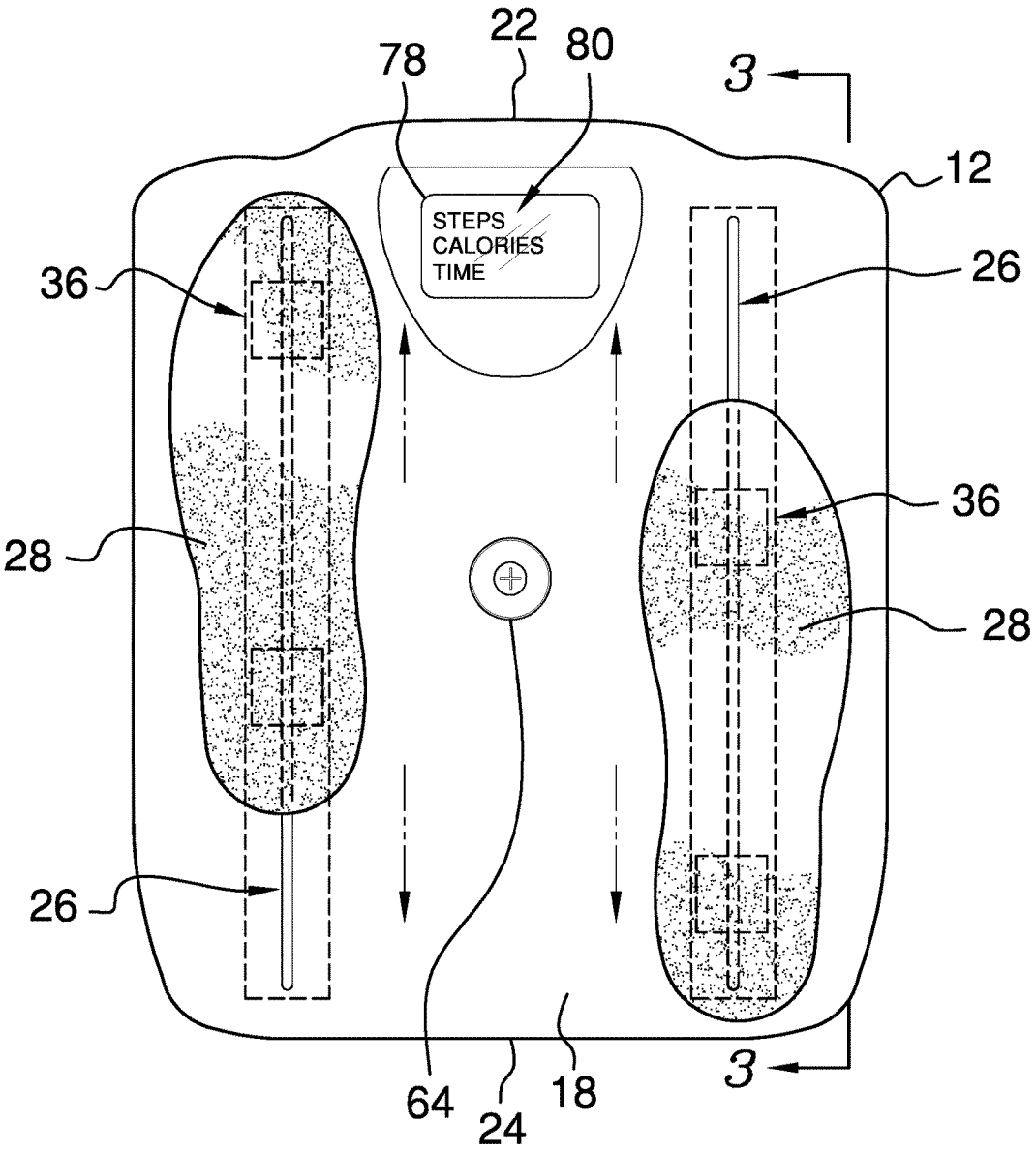
FIG. 2 is a top phantom view of an embodiment of the disclosure.
Figure 3:
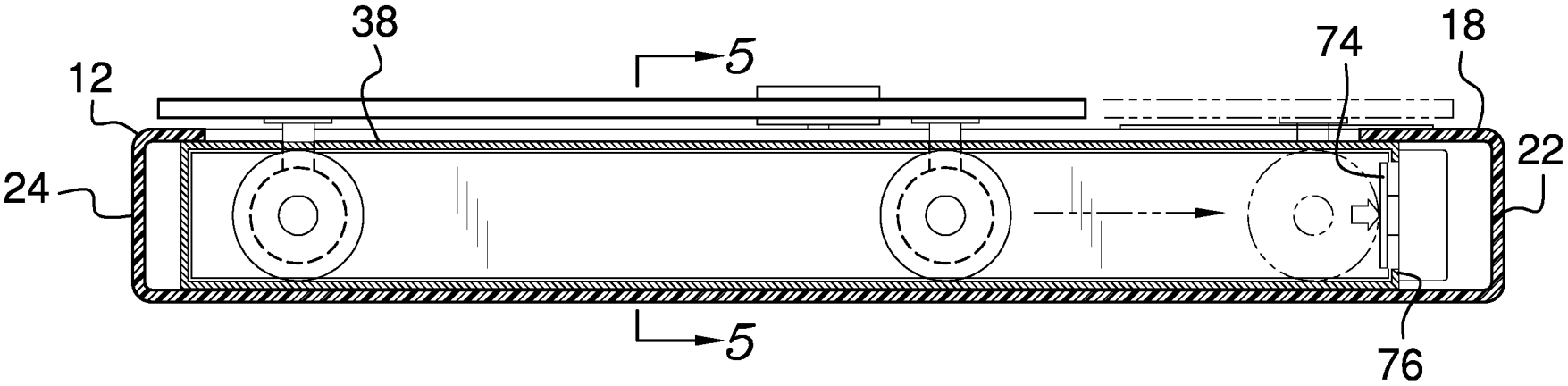
FIG. 3 is a cross sectional view taken along line 3-3 of FIG. 2 of an embodiment of the disclosure.
Figure 4:
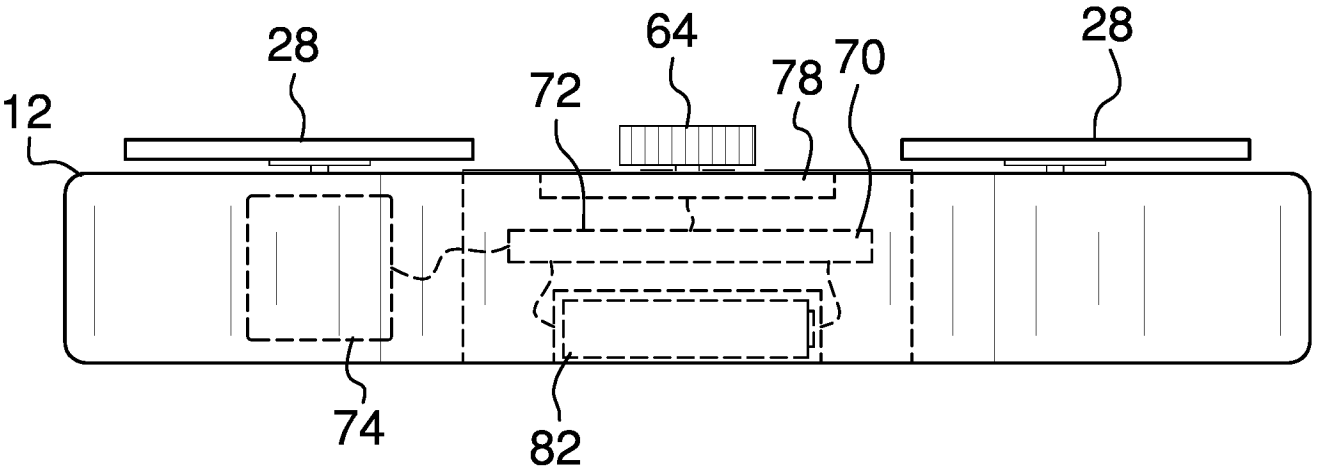
FIG. 4 is a back phantom view of an embodiment of the disclosure.
Figure 5:
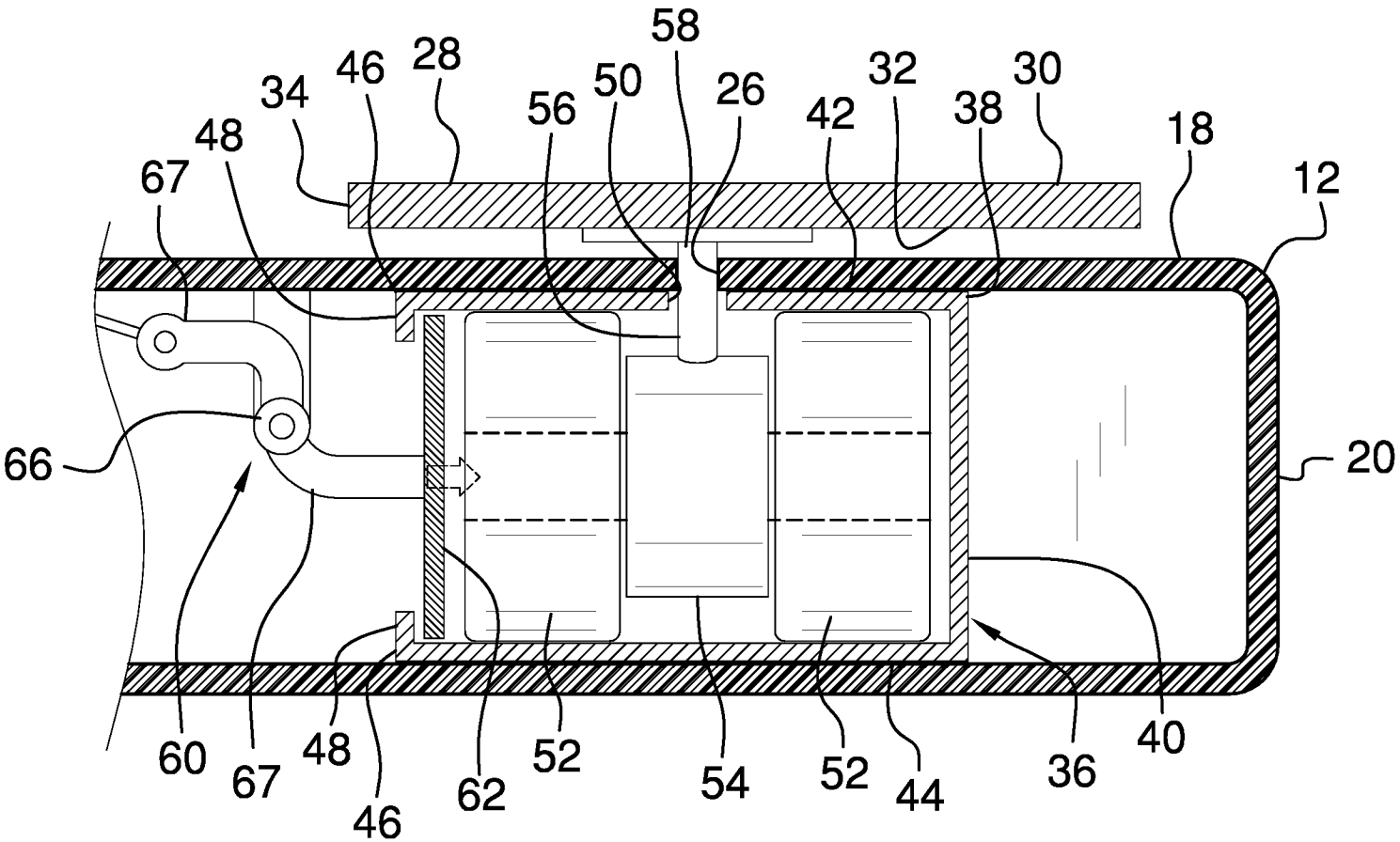
FIG. 5 is a cross sectional view taken along line 5-5 of FIG. 3 of an embodiment of the disclosure.
Figure 6:
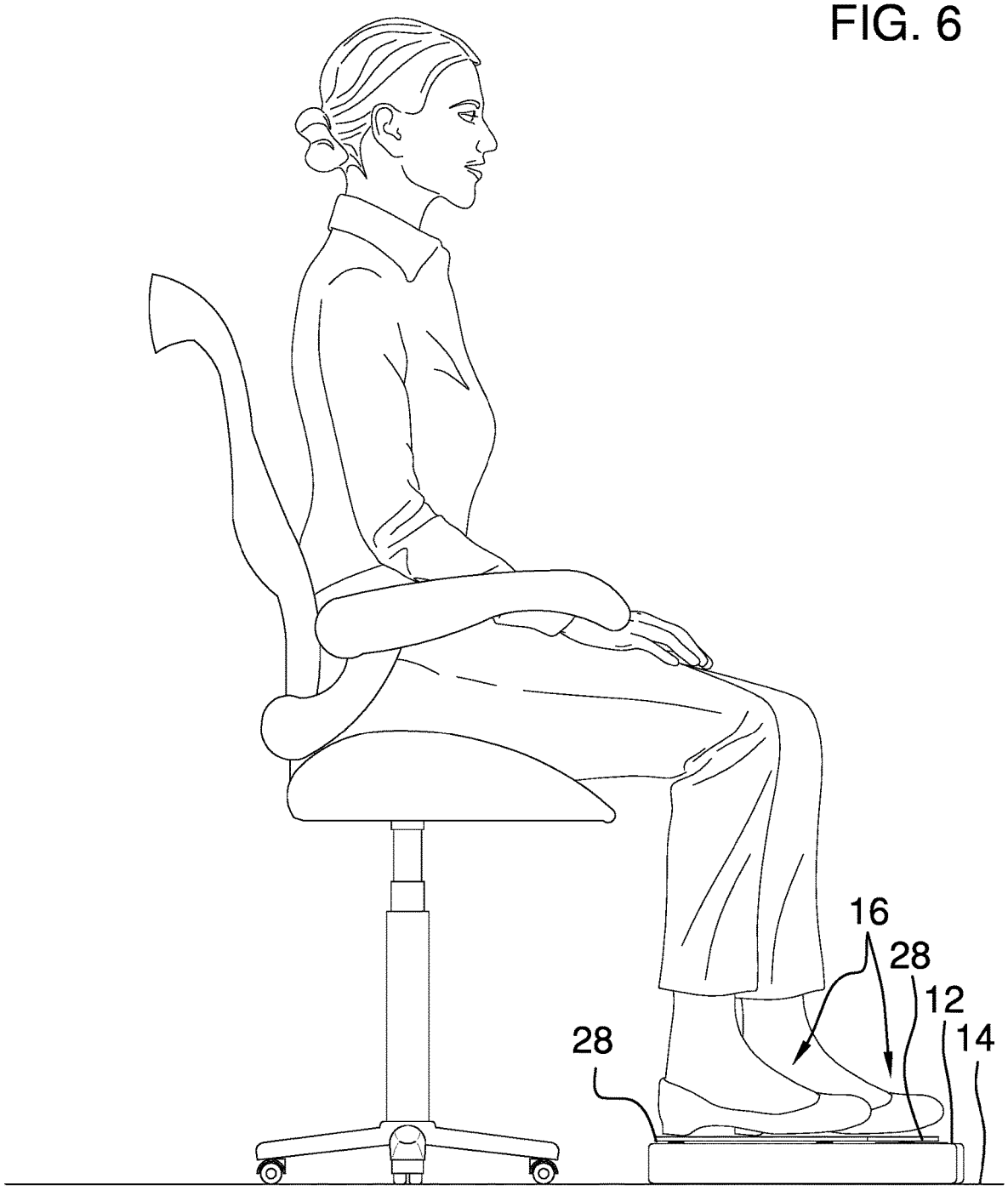
FIG. 6 is a perspective in-use view of an embodiment of the disclosure.

With reference now to the drawings, and in particular to FIGS. 1 through 6 thereof, a new exercise device embodying the principles and concepts of an embodiment of the disclosure and generally designated by the reference numeral 10 will be described.

As best illustrated in FIGS. 1 through 6, the leg exercise assembly 10 generally comprises a housing 12 that is positionable on a support surface 14 such that the housing 12 can be positioned near a user's feet 16. The housing 12 has a top wall 18 and an outer wall 20, the outer wall 20 has a front side 22 and a back side 24, and the top wall 18 has a pair of slots 26 each extending into an interior of the housing 12. Each of the slots 26 is elongated to extend substantially between the front side 22 and the back side 24 and each of the slots 26 is positioned on opposite sides of a centerline of the housing 12. A pair of foot pads 28 is each disposed on the housing 12 for having a respective one of the user's feet 16 positioned upon the foot pads 28. Each of the foot pads 28 has a top surface 30, a bottom surface 32 and a perimeter edge 34 extending between the top surface 30 and the bottom surface 32. The top surface 30 is textured to enhance traction and the perimeter edge 34 of each of the foot pads 28 undulates about an axis that is aligned with the slots 26 in the top wall 18 of the housing 12 such that each of the foot pads 28 simulates the shape of the user's foot.

A pair of roller units 36 is provided and the pair of roller units 36 is rollably integrated into the housing 12. Each of the foot pads 28 is coupled to a respective one of the roller units 36 thereby facilitating each of the foot pads 28 to be rolled forwardly or rearwardly on the housing 12. In this way each of the foot pads 28 can facilitate the user to move their feet 16 back and forth on the foot pads 28 while the user is seated. Each of the roller units 36 comprises a track 38 that has an outer portion 40 extending between an upper portion 42 and a lower portion 44, and the upper portion 42 and the lower portion 44 are oriented perpendicular to the outer portion 40 such that the track 38 has a U-shape. Each of the upper portion 42 and the lower portion 44 has a distal end 46 with respect to the outer portion 40.

Each of the upper portion 42 and the lower portion 44 has a lip 48 that is positioned adjacent to the distal end 46, and the lip 48 on each of the upper portion 42 and the lower portion 44 is directed toward each other. The track 38 is positioned within the housing 12 having the upper portion 42 resting against the top wall 18 of the housing 12. The upper portion 42 has a slot 50 extending through the upper portion 42 and the slot 50 in the upper portion 42 of the track of each of the roller units 36 is aligned with a respective one of the slots 26 in the top wall 18 of the housing 12. The track 38 is elongated to extend substantially between the front side 22 and the back side 24 of the outer wall 20 of the housing 12.

Each of the roller units 36 includes a pair of rollers 52 that is each rotatably positioned between the upper portion 42 and the lower portion 44 of the track 38. Each of the rollers 52 is laterally restrained by the outer portion 40 and the lip 48 on each of the upper portion 42 and the lower portion 44. Additionally, each of the rollers 52 is rollable along a full length of the track 38. Each of the roller units 36 includes an axle 54 extending between the pair of rollers 52, and the axle 54 includes a stem 56 extending upwardly through the slot 50 in the upper portion 42 of the track 38 and through the slot 50 in the top wall 18 of the housing 12. The stem 56 has a distal end 58 with respect to the axle 54 and the distal end 58 of the stem 56 is coupled to the bottom surface 32 of a respective one of the foot pads 28. Additionally, the stem 56 travels forwardly and rearwardly in the slot 50 in the top wall 18 of the housing 12 when the respective foot pad 28 is moved back and forth.

A resistance unit 60 is provided and the resistance unit 60 is movably integrated into the housing 12. The resistance unit 60 is in mechanical communication with the pair of roller units 36 and the resistance unit 60 is adjustable between a minimum resistance and a maximum resistance. In this way the resistance unit 60 can either increase or decrease the force required to move the foot pads 28 to accommodate the physical strength of the user. The resistance unit 60 comprises a panel 62 that is positioned in the track 38 and the panel 62 extends along a full length of the track 38. The panel 62 is positioned between a respective one of the rollers 52 and the lip 48 on each of the upper portion 42 and the lower portion 44.

The resistance unit 60 includes a knob 64 that is positioned on the top wall 18 of the housing 12 such that the knob 64 can be manipulated by the user. The knob 64 is rotatable in a tightening direction or a loosening direction. Additionally, the knob 64 might include a rheostat or other type of electronic control. The resistance unit 60 includes a linkage 66 that is coupled between the knob 64 and the panel 62, and the linkage 66 comprises a series of interconnected arms 67. The linkage 66 urges the panel 62 toward the respective roller 52 when the knob 64 is rotated in the tightening direction for increasing friction between the panel 62 and the respective roller 52. Conversely, the linkage 66 urges the panel 62 away from the respective roller 52 when the knob 64 is rotated in the loosening direction for decreasing friction between the panel 62.

A calorie counter 68 is provided and the calorie counter 68 is integrated into the housing 12. The calorie counter 68 is in mechanical communication with the pair of roller units 36 and the calorie counter 68 counts each time the pair of roller units 36 is moved back and forth. In this way the calorie counter 68 can calculate the calories is burnt by the user. The calorie counter 68 comprises a control circuit 70 that is positioned within the housing 12 and the control circuit 70 includes an electronic timer 72.

The calorie counter 68 may include a switch 74 that is positioned in the track 38. The switch 74 is electrically coupled to the control circuit 70 and the switch 74 is engaged by the rollers 52 each time the rollers 52 travel to a front end 76 of the track 38. Additionally, the control circuit 70 counts the number of times the switch 74 is engaged. The control circuit 70 may be in electrical communication with the knob 64 such to facilitate the control circuit 70 to calculate the amount of resistance imparted into the rollers 52. Additionally, the control circuit 70 includes software for calculating calories based upon the number of times the rollers 52 travel along the track 38 and the degree of resistance imparted on the rollers 52.

The calorie counter 68 includes a display 78 that is coupled to the top wall 18 of the housing 12 such that the display 78 is visible to a user. The display 78 is electrically coupled to the control circuit 70 and the display 78 may comprise a liquid crystal display or other type of electronic display. The display 78 displays indicia 80 comprising letters and numbers for communicating the number of times the switch 74 is engaged, the number of calories burned and the elapsed time counted by the electronic timer 72. The calorie counter 68 includes a power supply 82 that is positioned in the housing 12. The power supply 82 is electrically coupled to the control circuit 70 and the power supply 82 comprises at least one battery.

In use, the knob 64 is manipulated to adjust the resistance of the rollers 52 to satisfy the preference of the user. The user positions each of their feet 16 on the foot pads 28 and the user urges their feet 16 back and forth. In this way the user can exercise their legs while the user is seated during the workday, for example. Additionally, the user can track 38 the calories burned, the number of times they have moved their feet 16 back and forth on the foot pads 28 and the duration of elapsed time. In this way the user can exercise for a predetermined duration of time, or burn a predetermined amount of calories while the user is seated.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A leg exercise assembly for facilitating a user to move their feet back and forth while the user being seated, said assembly comprising:

a housing being positionable on a support surface wherein said housing being configured to be positioned near a user's feet;

a pair of foot pads, each of said foot pads being disposed on said housing wherein each of said foot pads being configured to have a respective one of the user's feet positioned upon said foot pads;

a pair of roller units, each of said roller units being rollably integrated into said housing, each of said foot pads being coupled to a respective one of said pair of roller units thereby facilitating each of said foot pads to be rolled forwardly or rearwardly on said housing wherein each of said foot pads being configured to facilitate the user to move their feet back and forth on said food pads while the user being seated;

a resistance unit being movably integrated into said housing, said resistance unit being in mechanical communication with said pair of roller units, said resistance unit being adjustable between a minimum resistance and a maximum resistance for either increasing or decreasing the force required to move said footpads wherein said resistance unit being configured to accommodate the physical strength of the user;

a calorie counter being integrated into said housing, said calorie counter being in mechanical communication with said pair of roller units, said calorie counter counting each time said pair of roller units being moved back and forth wherein said calorie counter being configured to calculate the calories being burnt by the user;

wherein said housing has a top wall and an outer wall, said outer wall having a front side and a back side, said top wall having a pair of slots each extending into an interior of said housing, each of said slots being elongated to extend substantially between said front side and said back side, each of said slots being positioned on opposite sides of a centerline of said housing;

wherein each of said roller units comprises a track having an outer portion extending between an upper portion and a lower portion, said upper portion and said lower portion being oriented perpendicular to said outer portion such that said track has a U-shape, each of said upper portion and said lower portion having a distal end with respect to said outer portion, each of said upper portion and said lower portion having a lip being positioned adjacent to said distal end, said lip on each of said upper portion and said lower portion being directed toward each other, said track being positioned within said housing having said upper portion resting against said top wall of said housing, said upper portion having a slot extending through said upper portion, said slot in said upper portion being aligned with said slot in said top wall of said housing, said track being elongated to extend substantially between said front side and said back side of said outer wall of said housing;

each of said foot pads has a top surface, a bottom surface and a perimeter edge extending between said top surface and said bottom surface, said top surface being textured wherein said top surface being configured to enhance traction, said perimeter edge of each of said foot pads undulating about an axis being aligned with said slots in said top wall of said housing wherein each of said foot pads being configured to simulate the shape of the user's foot;

each of said roller units comprises:

a pair of rollers, each of said rollers being rotatably positioned between said upper portion and said lower portion of said track, each of said rollers being laterally restrained by said outer portion and said lip on each of said upper portion and said lower portion, each of said rollers being rollable along a full length of said track, and an axle extending between said pair of rollers, said axle including a stem extending upwardly through said slot in said upper portion of said track and through said slot in said top wall of said housing, said stem having a distal end with respect to said axle, said distal end being coupled to said bottom surface of a respective one of said foot pads, said stem traveling forwardly and rearwardly in said slot in said top wall of said housing when said respective foot pad being moved back and forth; and wherein said resistance unit comprises:

a panel being positioned in said track, said panel extending along the full length of said track, said panel being positioned between said a respective one of said rollers and said lip on each of said upper portion and said lower portion, a knob being positioned on said top wall of said housing wherein said knob being configured to be manipulated by the user, said knob being rotatable in a tightening direction or a loosening direction, and a linkage being coupled between said knob and said panel, said linkage comprising a series of interconnected arms, said linkage urging said panel toward said respective roller when said knob being rotated in said tightening direction for increasing friction between said panel and said respective roller, said linkage urging said panel away from said respective roller when said knob being rotated in said loosening direction for decreasing friction between said panel.

2. The assembly according to claim 1, wherein said calorie counter comprises:

a control circuit being positioned within said using, said control circuit including an electronic timer;

a switch being positioned in said track, said switch being electrically coupled to said control circuit, said switch being engaged by said rollers each time said rollers travel to a front end of said track, said control circuit counting the number of times said switch being engaged; and a display being electrically coupled to said control circuit, said display displaying indicia comprising letters and numbers for communicating the number of times said switch being engaged, the number of calories burned and the elapsed time counted by said electronic timer.

3. A leg exercise assembly for facilitating a user to move their feet back and forth while the user being seated, said assembly comprising:

a housing being positionable on a support surface wherein said housing being configured to be positioned near a user's feet, said housing having a top wall and an outer wall, said outer wall having a front side and a back side, said top wall having a pair of slots each extending into an interior of said housing, each of said slots being elongated to extend substantially between said front side and said back side, each of said slots being positioned on opposite sides of a centerline of said housing;

a pair of foot pads, each of said foot pads being disposed on said housing wherein each of said foot pads being configured to have a respective one of the user's feet positioned upon said foot pads, each of said foot pads having a top surface, a bottom surface and a perimeter edge extending between said top surface and said bottom surface, said top surface being textured wherein said top surface being configured to enhance traction, said perimeter edge of each of said foot pads undulating about an axis being aligned with said slots in said top wall of said housing wherein each of said foot pads being configured to simulate the shape of the user's foot;

a pair of roller units being rollably integrated into said housing, each of said foot pads being coupled to said a respective one of said roller units thereby facilitating each of said foot pads to be rolled forwardly or rearwardly on said housing wherein each of said foot pads being configured to facilitate the user to move their feet back and forth on said food pads while the user being seated, each of said roller units comprising:

a track having an outer portion extending between an upper portion and a lower portion, said upper portion and said lower portion being oriented perpendicular to said outer portion such that said track has a U-shape, each of said upper portion and said lower portion having a distal end with respect to said outer portion, each of said upper portion and said lower portion having a lip being positioned adjacent to said distal end, said lip on each of said upper portion and said lower portion being directed toward each other, said track being positioned within said housing having said upper portion resting against said top wall of said housing, said upper portion having a slot extending through said upper portion, said slot in said upper portion being aligned with said slot in said top wall of said housing, said track being elongated to extend substantially between said front side and said back side of said outer wall of said housing;

a pair of rollers, each of said rollers being rotatably positioned between said upper portion and said lower portion of said track, each of said rollers being laterally restrained by said outer portion and said lip on each of said upper portion and said lower portion, each of said rollers being rollable along a full length of said track; and an axle extending between said pair of rollers, said axle including a stem extending upwardly through said slot in said upper portion of said track and through said slot in said top wall of said housing, said stem having a distal end with respect to said axle, said distal end being coupled to said bottom surface of a respective one of said foot pads, said stem traveling forwardly and rearwardly in said slot in said top wall of said housing when said respective foot pad being moved back and forth;

a resistance unit being movably integrated into said housing, said resistance unit being in mechanical communication with said pair of roller units, said resistance unit being adjustable between a minimum resistance and a maximum resistance for either increasing or decreasing the force required to move said footpads wherein said resistance unit being configured to accommodate the physical strength of the user, said resistance unit comprising:

a panel being positioned in said track, said panel extending along all the full length of said track, said panel being positioned between said a respective one of said rollers and said lip on each of said upper portion and said lower portion;

a knob being positioned on said top wall of said housing wherein said knob being configured to be manipulated by the user, said knob being rotatable in a tightening direction or a loosening direction; and a linkage being coupled between said knob and said panel, said linkage comprising a series of interconnected arms, said linkage urging said panel toward said respective roller when said knob being rotated in said tightening direction for increasing friction between said panel and said respective roller, said linkage urging said panel away from said respective roller when said knob being rotated in said loosening direction for decreasing friction between said panel; and a calorie counter being integrated into said housing, said calorie counter being in mechanical communication with said pair of roller units, said calorie counter counting each time said pair of roller units being moved back and forth wherein said calorie counter being configured to calculate the calories being burnt by the user, said calorie counter comprising:

a control circuit being positioned within said housing, said control circuit including an electronic timer;

a switch being positioned in said track, said switch being electrically coupled to said control circuit, said switch being engaged by said rollers each time said rollers travel to a front end of said track, said control circuit counting the number of times said switch being engaged;

a display being coupled to said top wall of said housing wherein said display being configured to be visible to a user, said display being electrically coupled to said control circuit, said display displaying indicia comprising letters and numbers for communicating the number of times said switch being engaged, the number of calories burned and the elapsed time counted by said electronic timer; and a power supply being positioned in said housing, said power supply being electrically coupled to said control circuit, said power supply comprising at least one battery.

* * * * *